United States Patent [19]

Humphrey

[11] Patent Number: 4,482,455

[45] Date of Patent: Nov. 13, 1984

[54] DUAL FREQUENCY VIBRATORY SCREEN FOR CLASSIFYING GRANULAR MATERIAL

[76] Inventor: Cecil T. Humphrey, 5589 Regent St., Burnaby, B.C., Canada, V5B 4R6

[21] Appl. No.: 367,122

[22] Filed: Apr. 9, 1982

[30] Foreign Application Priority Data

Oct. 16, 1981 [CA] Canada ..... 388058

[51] Int. Cl.[3] ..... B07B 1/28

[52] U.S. Cl. ..... 209/319; 209/329; 209/366.5; 209/405; 209/412

[58] Field of Search ..... 209/315, 319, 325-327, 209/329, 365 R, 366, 366.5, 405, 408, 412

[56] References Cited

U.S. PATENT DOCUMENTS

| | | | |
|---|---|---|---|
| 2,311,279 | 2/1943 | Parks | 209/366 |
| 2,358,449 | 9/1944 | Finney et al. | 209/326 |
| 2,477,123 | 7/1949 | Gilson | 209/326 |
| 2,874,841 | 2/1959 | Peterson | 209/329 |
| 3,087,617 | 4/1963 | Forsberg | 209/326 |
| 3,129,167 | 4/1964 | Frangos | 209/315 |
| 3,261,469 | 7/1966 | Wehner | 209/325 |
| 3,347,373 | 10/1967 | Dahlberg | 209/315 |
| 3,372,793 | 3/1968 | Redford et al. | 209/329 |
| 3,378,142 | 4/1968 | Wehner | 209/325 |
| 3,511,373 | 5/1970 | McKibben et al. | 209/234 |
| 3,666,095 | 5/1972 | Krynock et al. | 209/326 |
| 3,954,604 | 5/1976 | Krause et al. | 209/325 |
| 4,167,478 | 9/1979 | Salete | 209/366.5 |
| 4,224,146 | 9/1980 | Kent et al. | 209/405 |
| 4,315,817 | 2/1982 | Popper | 209/315 |
| 4,319,993 | 3/1982 | Krause | 209/412 |

FOREIGN PATENT DOCUMENTS

| | | | |
|---|---|---|---|
| 1757423 | 6/1971 | Fed. Rep. of Germany | 209/327 |
| 2929806 | 2/1981 | Fed. Rep. of Germany | 209/319 |

*Primary Examiner*—David Lacey

*Attorney, Agent, or Firm*—Beveridge, DeGrandi & Kline

[57] ABSTRACT

An apparatus for classifying granular material comprises an outer frame and an inner frame, a screen deck mounted in the inner frame; apparatus suspending the inner frame and deck from the outer frame; resilient apparatus mounting the deck on the inner frame; apparatus for vibrating the at least one screen at the high frequency and in a generally vertical plane and apparatus for applying the lower frequency motion to the inner frame and deck in a generally horizontal plane.

8 Claims, 4 Drawing Figures

DUAL FREQUENCY VIBRATORY SCREEN FOR CLASSIFYING GRANULAR MATERIAL

FIELD OF THE INVENTION

This invention relates to methods and apparatus for classifying granular material such as coal, wheat or the like and, in particular, to granular material where both large and small particles are present. One or more screens are employed with motion of the screens in both horizontal and vertical planes.

BACKGROUND OF THE INVENTION

Conventional vibrating type screens are used almost exclusively with a vertically oriented action, small in dimension but applied at fairly high speed. Such vibration has been necessary to process small particles and is normally used in combination with wash water if the apparatus is used in an environment such as the coal industry. However, the high frequency, small throw motion is not effective for moving large volumes of granular material and the vertical action in itself does not provide high capacity screening.

Some attempts have been made to apply a compound vibration to a screen as exemplified in U.S. Pat. No. 3,378,142 of Apr. 16, 1968 to WEHNER and U.S. Pat. No. 3,261,469 of July 19, 1966. These patents disclose a vibratory screen device in which a compound vibration of the screen is disclosed. These motions are a vertical and a circular or semi-circular to-and-fro motion to the screen, these motions being applied through the use of a single motor. However, these patents do not disclose an apparatus similar to the present invention where two distinct and separate motions are applied to the screen for greater control over the action of the apparatus.

SUMMARY OF THE INVENTION

According to the present invention, the apparatus combines a high screening capacity of a flat rotary, large throw motion with a high speed vertical motion of the vibratory type in a small throw range which minimizes the vertical reaction forces at the support areas of the screens. With the present invention, the reactions from a large horizontal throw are small as they are always in balance in the horizontal plane, not up and down against gravity. This provides an advantage of large throw agitation combined with high frequency screening and minimum reaction at the screen supports.

Basically, a flat, rotary form of screen is provided with a vertically oriented vibratory apparatus. The result is that the whole of the machine has a flat rotary action of, for example, 300 r.p.m. with a two inch throw and the screen decks, at the same time, are vibrated in generally vertical orientation at 3,000 to 4,000 r.p.m. with a small throw, for example, of up to ¼ of an inch.

The apparatus can be arranged in various configurations one being that all of the decks inside of a main frame are vibrated at high speed or just the lower deck or decks or only the top deck.

According to one broad aspect, the invention relates to a method of classifying granular material in which the material is passed through at least one screen of a vibrating machine, applying movement to the screen in different planes including a lower frequency, large throw motion in a horizontal plane and at least one higher frequency, small throw motion in a vertial plane.

According to a further broad aspect, the invention relates to a vibrating screen apparatus for classifying granular material, the apparatus comprising an outer frame and an inner frame. A screen deck is mounted in the inner frame and means suspend the inner frame and the screen deck from the outer frame. Resilient means are used to mount the screen deck on the inner frame and means are provided for vibrating the screen deck at a high frequency and in a generally vertical plane and means are further provided for applying a low frequency motion to the inner frame and the screen deck in a generally horizontal plane.

According to a further broad aspect, the invention relates to vibrating screen apparatus for classifying granular material comprising an outer and an inner frame, a plurality of screen decks mounted in the inner frame; means suspending the inner frame and said plurality of screen decks from the outer frame; resilient means intermediate the screen decks and the inner frame; means for vibrating at least one of the screen decks at a high frequency and in a generally vertical plane and means for applying a low frequency motion to said inner frame and all of said screen decks in a generally horizontal plane.

BRIEF DESCRIPTION OF THE DRAWINGS

The invention is illustrated by way of example in the accompanying drawings in which.

Figure 1:
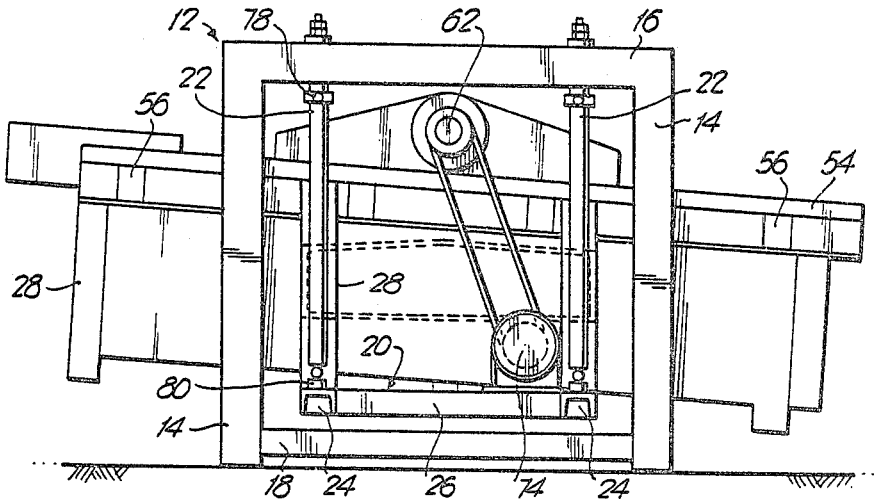
FIG. 1 is a side elevation of one form of apparatus according to the invention.

The drawings illustrate one embodiment of the present invention in which a single screen deck is mounted for horizontal oscillation and vertical vibratory movement and another embodiment of a double deck arrangement with screens in upper and lower sections.

Referring to the drawings, the apparatus indicated generally at 10 includes a main outer frame 12 of cage-like configuration and including uprights 14 connected by upper and lower horizontal members 16 and 18, respectively.

Figure 3:
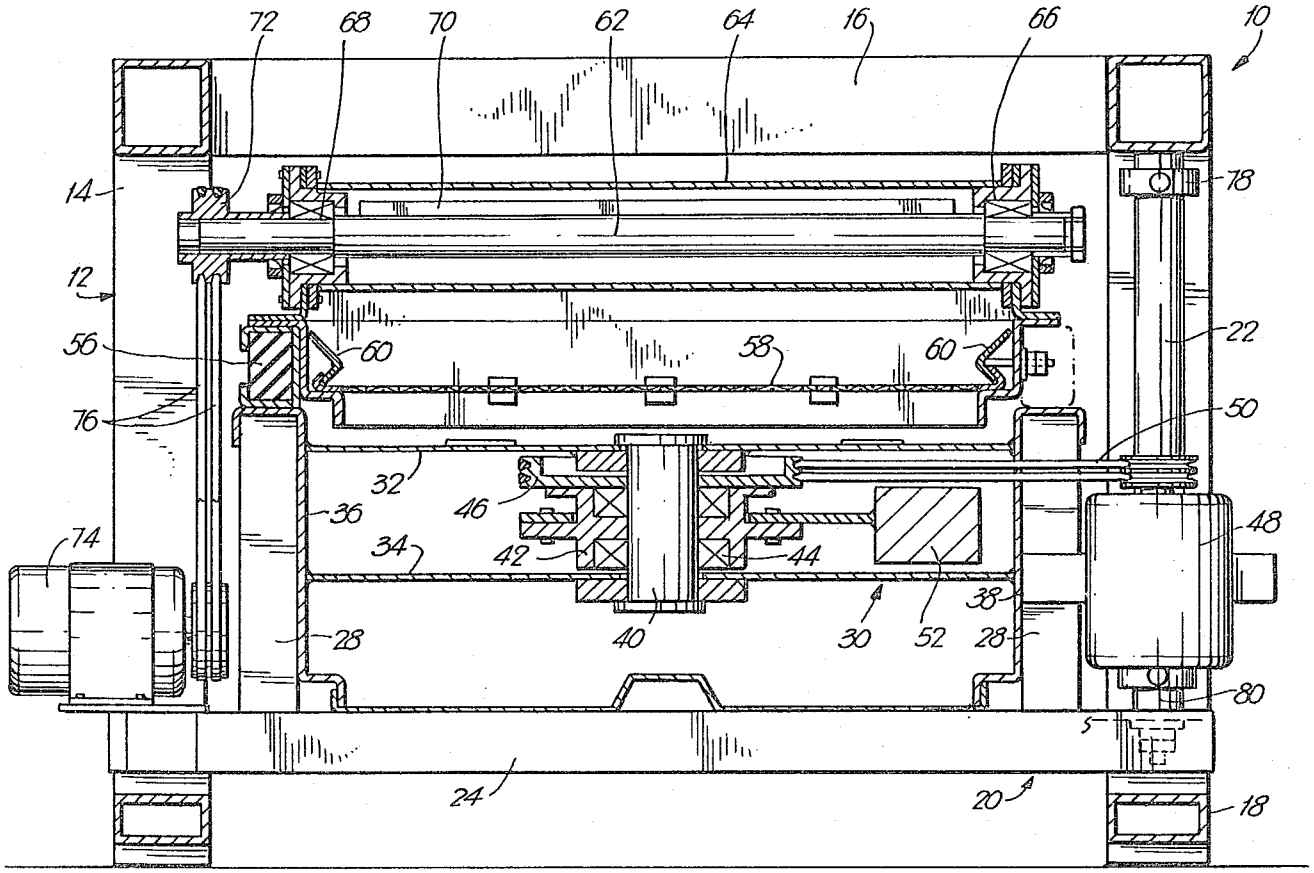
FIG. 3 is a sectional view taken generally along the line 3—3 of FIG. 2.

An inner frame 20 is mounted within and suspended from the outer frame 12 by hangers 22, those on the left side of FIG. 3 being omitted for clarity. Frame 20 includes a pair of lower cross members 24 and lower, longitudinally extending beams 26. Vertically extending side members 28 cradle and support a low frequency drive unit indicated generally at 30 in FIG. 3 and, as shown in that Figure, the drive unit 30 consists of a closed box comprising upper and lower walls 32, 34 and side walls 36 and 38. A dead shaft 40 is mounted between the upper and lower walls 32, 34 and the shaft 40 supports a sleeve 42 which, through bearings 44, is mounted for rotation on the shaft 40. Sleeve 42 is provided with a sheave 46 interconnected to a drive motor 48 by suitable drive means such as V-belts 50. Sleeve 42 also includes an eccentrically positioned weight 52 which, when the sleeve 42 is rotated by the drive means 48, effects a low frequency horizontal motion to the inner frame 20 and anything attached to it.

A screen deck assembly 54 is mounted on the inner frame 20 and is secured to the vertical members 28 of the inner frame 20 by resilient mounts such as springs or rubber blocks 56. A screen 58 is mounted in the assembly 54 and includes suitable tensioning devices 60. The means to apply high frequency vibration to this screen consists of a shaft 62 mounted for rotation in a housing 64 that extends transverse of and is secured to the upper section of the deck assembly 54, as illustrated in FIGS. 1 and 3. The housing 64 includes suitable bearing assemblies 66, 68 to allow rotation of shaft 62, which is also provided with an eccentrically positioned weight 70 extending substantially throughout its length. One terminal end of shaft 62 is provided with a pulley 72 that is utilized to rotate the shaft 62 in response to action of a suitable motor 74 mounted on the inner frame 20 as shown on FIG. 3, and connected to the pulley 72 by drive belts 76.

Suspension hangers 22 have universal type joints 78 and 80 at their upper and lower ends respectively interconnecting hangers 22 to the outer frame 12 at their top ends and to the inner frame 20 at their lower ends. It will be understood therefore that operation of the motor 48 and rotation of the weight 52 thereby will cause a flat rotary motion to be applied to the inner frame 20 and the deck 54 attached thereto. At the same time, operation of motor 74 and rotation of shaft 62 will cause a high frequency vibratory action in a vertical plane to the screen deck assembly 54 and, in particular, to the screen 58. The resilient mounts 56 serve to isolate the vibratory action of the screen deck 54 from the structure of the drive box 30.

In one structural example, the motor 48 applies a two inch rotary throw or movement to the inner frame 20 by virtue of an approximate 300 r.p.m. rotation of the eccentrically located weight 52. The motor 74 in rotating the shaft 62 between 3,000 or 4,000 r.p.m. provides a vertical throw of approximately ¼ of an inch to the screen deck.

Figure 4:
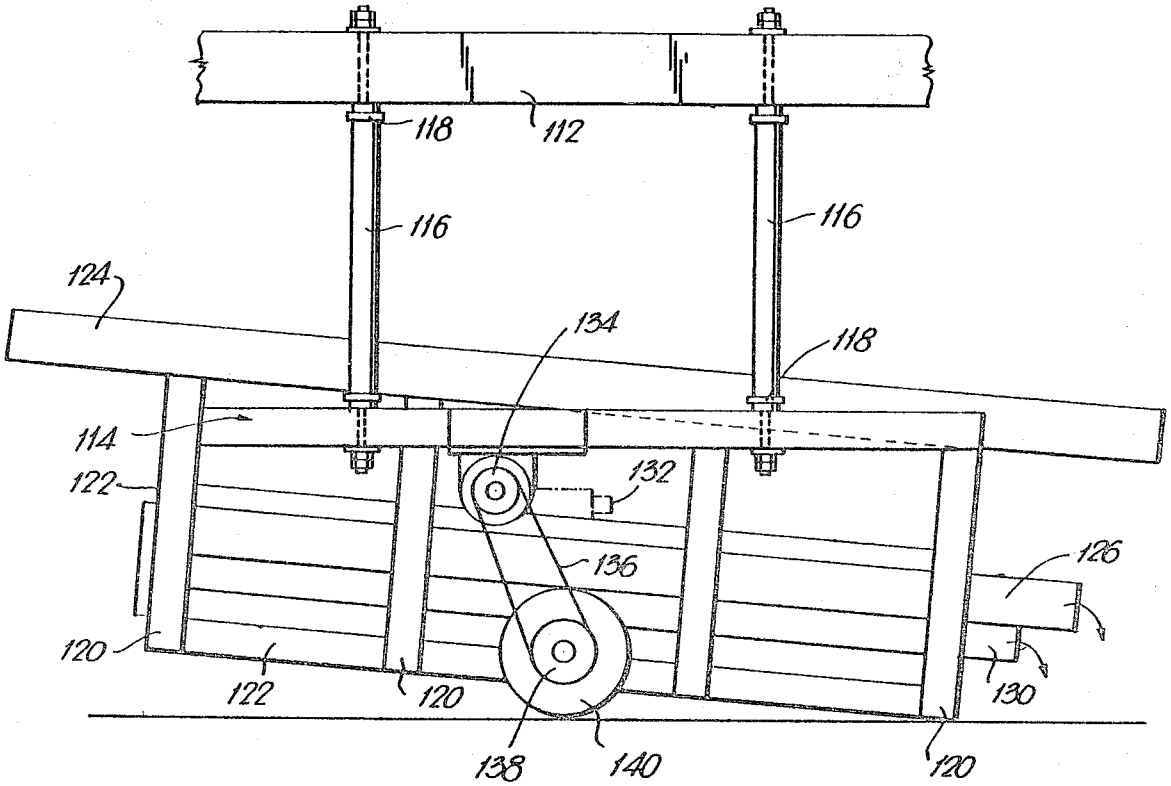
FIG. 4 is a schematic side elevation of a second embodiment of the invention.

Referring to FIG. 4, a further embodiment of the invention is shown in which a double deck and pan is mounted on the inner frame, one deck being mounted above the other and both being mounted over the cleaning pan. For the purposes of clarity, many of the details mentioned with respect to the first embodiment have been omitted from FIG. 4 but it will be seen that the embodiment again uses an outer frame 112 suspending and carrying an inner, cage frame 114 through a plurality of spaced hangers 116 interconnecting the inner and outer frames at their lower and upper ends respectively through universal type joints 118.

Figure 2:
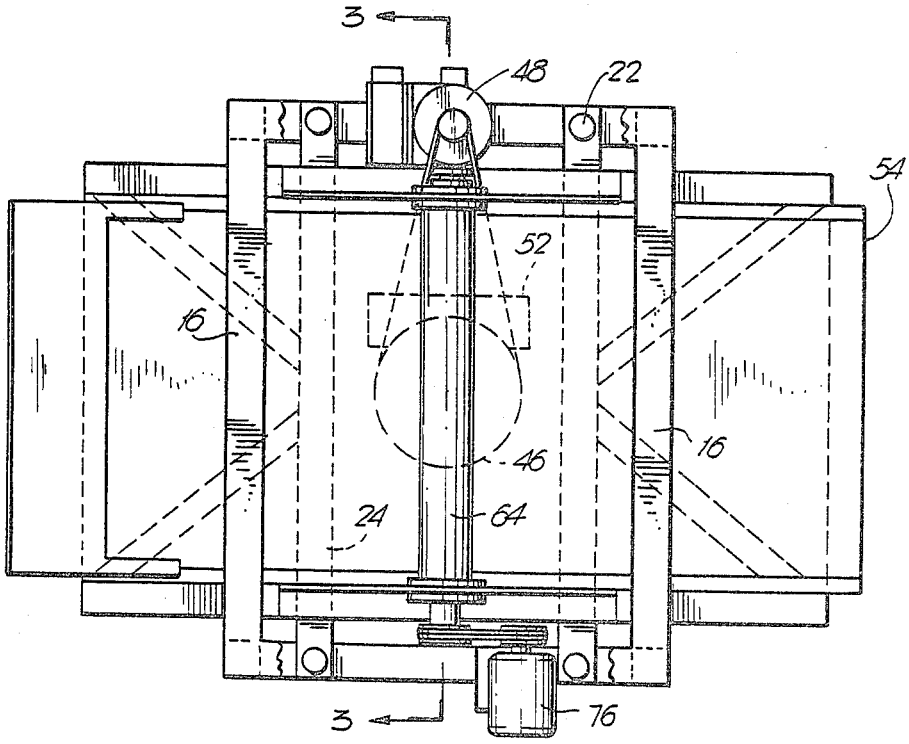
FIG. 2 is a plan view of the apparatus shown in FIG. 1.

Frame 114 includes a plurality of side members positioned in a generally upright direction and interconnected with a suitable number of horizontal members 122. Frame 114 supports and has secured to it an upper deck 124 which would be provided with large holes or apertures for a first, screening or classifying step. In the lower end of the frame 114 is a shorter, second deck 126 which would be provided with smaller apertures for a second classifying step and beneath deck 126 would be a pan 130. Means for driving the inner frame 114 and the decks and pan attached to it in a flat horizontal motion, would be the same as the drive means in the embodiment of FIGS. 1–3 and would be located centrally of the device between the upper and lower decks 124, 126 in the general region indicated at 132. A second drive means 134 is mounted on the inner frame and connected by a belt 136 to the pulley 138 of a vibrator 140 for applying a high frequency, vertical vibration to the frame 114, decks 124, 126 and the pan 130.

It will be appreciated that the drawings illustrate the present invention in two of its simplest forms, requiring only two drive units. Other alternatives could incorporate two or more high frequency drive units operating on upper and lower decks. For example, in place of the eccentric type high frequency vibrator illustrated in FIG. 3, a hummer form of vibrator could be used. Hummer vibrators incorporate electrically excited solenoids which are suitably interconnected to the screen 58 and actuation of the solenoid through such connection applies new vertical vibration to the screen.

While the present invenion has been described in connection with specific embodiments thereof and in a specific use, various modifications thereof will occur to those skilled in the art without departing from the spirit and scope of the invention as set forth in the attached claims.

The terms and expressions which have been used in this disclosure are used as terms of description and not of limitation. There is no intention in the use of such terms and expressions to exclude any equivalence of the features shown and described or portions thereof. It is recognized that various modifications are possible within the scope of the invention claimed.

The embodiments of the invention in which an exclusive property or privilege is claimed are defined as follows:

1. A vibration screen apparatus for classifying granular material comprising:
   an outer frame;
   an inner frame;
   a screen deck;
   resilient means mounting said screen deck on said inner frame;
   means suspending the inner frame and screen deck from the outer frame;
   means for vibrating said screen deck at a high frequency in a generally vertical plane; and
   means for applying a lower frequency motion to said inner frame and said screen deck in a generally horizontal plane.

2. Apparatus according to claim 1 wherein the resilient mounting means comprises rubber-like blocks between said screen deck and said inner frame to isolate said inner frame from said high frequency vibrations applied to said screen deck.

3. Apparatus according to claim 1 wherein the means for vibrating said screen deck at a high frequency comprises a shaft housing mounted across and secured to said screen deck, a rotatable shaft located in said housing, an eccentrically positioned weight on said shaft and motor means mounted on said inner frame for rotating said shaft.

4. Apparatus according to claim 1 wherein the means for applying said lower frequency motion comprises a housing adjacent said screen deck, a centrally located, vertically oriented dead shaft mounted in said housing, an eccentric weight mounted on said dead shaft and motor means for rotating said eccentric weight on said dead shaft.

5. A vibrating apparatus for classifying granular material comprising:
   an outer frame;
   an inner frame;
   a plurality of screen decks mounted on the inner frame;
   means suspending said inner frame and said plurality of screen decks from said outer frame;

resilient means intermediate said plurality of screen decks and said inner frame and mounting the screen decks to said inner frame;

means for vibrating at least one of said screen decks at a high frequency and in a generally vertical plane; and means for applying a low frequency motion to said inner frame and all of said screen decks in a generally horizontal plane.

6. Apparatus according to claim 5 wherein the resilient mounting means comprises rubber-like blocks between said screen decks and said inner frame to isolate said inner frame from said high frequency vibrations applied to said screen decks.

7. Apparatus according to claim 5 wherein the means for vibrating at least one of said screen decks at a high frequency comprises a shaft housing mounted across and secured to one of said screen decks, a rotatable shaft located in said housing, an eccentrically positioned weight on said shaft and motor means mounted on said inner frame for rotating said shaft.

8. Apparatus according to claim 5 wherein the means for applying low frequency motion comprises a housing adjacent said screen decks, a centrally located, vertically oriented dead shaft mounted in said housing, an eccentric weight mounted on said dead shaft and motor means for rotating said eccentric weight on said dead shaft.

* * * * *